US009169052B2

(12) United States Patent
Bowers et al.

(10) Patent No.: US 9,169,052 B2
(45) Date of Patent: Oct. 27, 2015

(54) RUPTURABLE BLISTER PACKAGE

(75) Inventors: Paul K. Bowers, Long Valley, NJ (US); Alejandra Buitrago, Randolph, NJ (US)

(73) Assignee: Intercontinental Great Brands LLC, East Hanover, NJ (US)

( * ) Notice: Subject to any disclaimer, the term of this patent is extended or adjusted under 35 U.S.C. 154(b) by 1087 days.

(21) Appl. No.: 11/800,058

(22) Filed: May 3, 2007

(65) Prior Publication Data

US 2008/0073240 A1 Mar. 27, 2008

Related U.S. Application Data

(60) Provisional application No. 60/847,263, filed on Sep. 26, 2006.

(51) Int. Cl.
*B65D 75/32* (2006.01)

(52) U.S. Cl.
CPC ..... *B65D 75/32* (2013.01)

(58) Field of Classification Search
CPC ..... A61B 19/026; A61F 2/0095; A61J 1/03; A61J 1/035; A61J 7/04; B65D 2215/04; B65D 2575/3227; B65D 75/327
USPC ..... 206/530, 484, 531, 469, 532, 538, 534, 206/539, 1–4, 13, 16–18, 20–24, 35, 37, 206/39–43; 128/203.15; 53/453
See application file for complete search history.

(56) References Cited

U.S. PATENT DOCUMENTS 2,317,860 A 4/1943 Sorensen
2,380,367 A 7/1945 Ranney
3,035,691 A * 5/1962 Rasmussen et al. ..... 206/364
3,421,615 A * 1/1969 Cristina et al. ..... 206/469
3,472,367 A 10/1969 Hellstrom
3,502,486 A * 3/1970 Lundquist ..... 426/127
3,580,466 A 5/1971 Thelen et al.
3,583,558 A 6/1971 Davis
3,759,371 A * 9/1973 Marks ..... 206/531
3,872,970 A 3/1975 Edison
3,942,640 A * 3/1976 Hellstrom ..... 206/469
3,948,394 A 4/1976 Hellstrom
4,046,257 A 9/1977 Lehmacher
4,077,178 A 3/1978 Nelson et al.
4,090,635 A 5/1978 Nelson et al.
RE29,705 E 7/1978 Compere
4,243,144 A 1/1981 Margulies
4,294,361 A 10/1981 Margulies et al.
4,317,399 A 3/1982 Romagnoli
4,342,395 A 8/1982 Brown
4,371,080 A 2/1983 Haines
4,460,088 A 7/1984 Rugenstein et al.

(Continued)

FOREIGN PATENT DOCUMENTS

DE 4402038 1/1995
DE 4402038 7/1995

(Continued)

*Primary Examiner* — Anthony Stashick
*Assistant Examiner* — Kaushikkumar Desai
(74) *Attorney, Agent, or Firm* — Hoffmann & Baron, LLP

(57) ABSTRACT

The package supports a plurality of consumable products. The package is a blister package having a plurality of consumable products housed in a blister tray and covered with a rupturable sheet. The sheet overlies the open surfaces of the blister tray and includes rupturable locations formed thereon for permitting passage of the product therethrough.

20 Claims, 8 Drawing Sheets

(56) References Cited

U.S. PATENT DOCUMENTS

| | | | | |
|---|---|---|---|---|
| 4,516,428 | A | 5/1985 | Konomi | |
| 4,537,312 | A | 8/1985 | Intini | |
| 4,537,545 | A | 8/1985 | Kunzmann | |
| 4,609,107 | A | 9/1986 | Martin et al. | |
| 4,610,357 | A | 9/1986 | Nakamura | |
| 4,658,963 | A | 4/1987 | Jud | |
| 4,682,976 | A | 7/1987 | Martin et al. | |
| 4,709,822 | A | 12/1987 | Vataru | |
| 4,874,096 | A | 10/1989 | Tessera-Chiesa | |
| 4,911,304 | A * | 3/1990 | Bunin | 206/531 |
| 5,001,956 | A | 3/1991 | Nitsch | |
| 5,014,851 | A | 5/1991 | Wick | |
| 5,041,317 | A | 8/1991 | Greyvenstein | |
| 5,150,793 | A | 9/1992 | Tannenbaum | |
| 5,236,749 | A | 8/1993 | Ewing | |
| 5,252,279 | A | 10/1993 | Gore et al. | |
| 5,306,190 | A | 4/1994 | Spina et al. | |
| 5,307,934 | A | 5/1994 | Hagner | |
| 5,310,060 | A | 5/1994 | Bitner et al. | |
| 5,339,960 | A | 8/1994 | Price | |
| 5,360,116 | A * | 11/1994 | Schmiletzky | 206/531 |
| 5,468,039 | A | 11/1995 | Matsumoto et al. | |
| 5,469,968 | A * | 11/1995 | Matthews et al. | 206/532 |
| RE35,113 | E | 12/1995 | Grim | |
| 5,496,605 | A | 3/1996 | Augst et al. | |
| 5,529,188 | A * | 6/1996 | Coggswell | 206/531 |
| 5,616,387 | A | 4/1997 | Augst et al. | |
| 5,632,378 | A | 5/1997 | Provost | |
| 5,714,107 | A | 2/1998 | Levy et al. | |
| 5,759,241 | A | 6/1998 | Klett et al. | |
| 5,761,982 | A | 6/1998 | Abt et al. | |
| 5,790,900 | A | 8/1998 | Katsura et al. | |
| 5,791,478 | A | 8/1998 | Kalvelage et al. | |
| 5,797,484 | A | 8/1998 | Sentementes | |
| 5,797,494 | A | 8/1998 | Balling et al. | |
| 5,865,367 | A | 2/1999 | Benham | |
| 5,927,500 | A | 7/1999 | Godfrey et al. | |
| 5,944,191 | A | 8/1999 | Ray et al. | |
| 5,996,797 | A | 12/1999 | Flaig | |
| 6,006,913 | A | 12/1999 | Ludemann et al. | |
| 6,029,921 | A | 2/2000 | Johnson | |
| 6,041,930 | A | 3/2000 | Cockburn | |
| 6,045,858 | A | 4/2000 | Hamano | |
| 6,059,182 | A | 5/2000 | Wein | |
| 6,105,776 | A | 8/2000 | Meilhon | |
| 6,210,825 | B1 | 4/2001 | Takada et al. | |
| 6,212,858 | B1 | 4/2001 | Breitler | |
| 6,213,132 | B1 | 4/2001 | Andrews | |
| 6,230,441 | B1 | 5/2001 | Weder et al. | |
| 6,277,229 | B1 | 8/2001 | Popat et al. | |
| 6,277,459 | B1 | 8/2001 | Lencoski et al. | |
| 6,309,105 | B1 | 10/2001 | Palumbo | |
| 6,372,270 | B1 | 4/2002 | Denny | |
| 6,394,340 | B1 | 5/2002 | Anchor et al. | |
| 6,422,391 | B1 | 7/2002 | Swartz | |
| 6,479,625 | B1 | 11/2002 | Moore | |
| 6,516,949 | B2 * | 2/2003 | Fuller et al. | 206/530 |
| 6,531,242 | B1 | 3/2003 | Sugimoto et al. | |
| 6,571,700 | B2 | 6/2003 | Nakamura et al. | |
| 6,637,431 | B2 | 10/2003 | Ekelius et al. | |
| 6,659,280 | B2 | 12/2003 | Paliotta et al. | |
| 6,802,422 | B2 | 10/2004 | Kalvelage et al. | |
| 6,896,139 | B2 * | 5/2005 | Kancsar et al. | 206/531 |
| 6,908,318 | B2 | 6/2005 | Kawate | |
| 6,974,470 | B2 | 12/2005 | Tsunakawa et al. | |
| 6,983,857 | B2 * | 1/2006 | Miller et al. | 215/270 |
| 7,011,226 | B2 | 3/2006 | Uchiyama | |
| 7,093,716 | B2 | 8/2006 | Intini | |
| 7,138,169 | B2 | 11/2006 | Shiota et al. | |
| 7,188,728 | B2 | 3/2007 | Williams-Hartman | |
| 7,311,649 | B1 | 12/2007 | Plourde | |
| 7,388,462 | B2 | 6/2008 | Ahn et al. | |
| 7,410,804 | B2 | 8/2008 | Wendelbo et al. | |
| 7,422,516 | B2 | 9/2008 | Butterfield et al. | |
| 7,425,191 | B2 | 9/2008 | Letherer | |
| 7,431,837 | B2 | 10/2008 | Cohee et al. | |
| 7,435,155 | B2 | 10/2008 | Reinisch et al. | |
| 2001/0042430 | A1 | 11/2001 | Negishi | |
| 2002/0045024 | A1 | 4/2002 | Wise | |
| 2002/0108482 | A1 | 8/2002 | Negishi | |
| 2002/0142130 | A1 | 10/2002 | Irwin et al. | |
| 2002/0162768 | A1 | 11/2002 | Bolnick et al. | |
| 2003/0051440 | A1 | 3/2003 | Chow et al. | |
| 2003/0102247 | A1 | 6/2003 | Inoue et al. | |
| 2003/0127533 | A1 * | 7/2003 | Stihl | 239/8 |
| 2003/0190461 | A1 | 10/2003 | McKeigue et al. | |
| 2003/0196984 | A1 | 10/2003 | Uchiyama | |
| 2004/0175527 | A1 | 9/2004 | Shiota et al. | |
| 2004/0178112 | A1 * | 9/2004 | Snyder | 206/534 |
| 2004/0262253 | A1 | 12/2004 | Miller et al. | |
| 2005/0016134 | A1 | 1/2005 | Prebelli et al. | |
| 2005/0103789 | A1 | 5/2005 | O'Hara | |
| 2005/0145683 | A1 | 7/2005 | Alagna et al. | |
| 2005/0156018 | A1 | 7/2005 | Choat | |
| 2005/0178692 | A1 * | 8/2005 | Chang | 206/531 |
| 2005/0205229 | A1 | 9/2005 | Jiang et al. | |
| 2005/0205389 | A1 | 9/2005 | Karlsson | |
| 2005/0226542 | A1 | 10/2005 | Kendall et al. | |
| 2005/0233209 | A1 | 10/2005 | Sudano et al. | |
| 2005/0276525 | A1 | 12/2005 | Hebert et al. | |
| 2005/0280169 | A1 | 12/2005 | Yao et al. | |
| 2005/0284789 | A1 * | 12/2005 | Carespodi | 206/461 |
| 2006/0124718 | A1 | 6/2006 | Matty | |
| 2006/0147129 | A1 | 7/2006 | Miller | |
| 2006/0174435 | A1 | 8/2006 | McKay | |
| 2006/0225320 | A1 | 10/2006 | Dregalla et al. | |
| 2007/0023390 | A1 | 2/2007 | Kumar | |
| 2007/0110955 | A1 | 5/2007 | Eevers et al. | |
| 2007/0192317 | A1 | 8/2007 | Finley et al. | |
| 2007/0193934 | A1 | 8/2007 | Shukla et al. | |
| 2007/0212966 | A1 | 9/2007 | Wittner et al. | |
| 2007/0215612 | A1 | 9/2007 | Hicks et al. | |
| 2007/0227932 | A1 | 10/2007 | Bobbett et al. | |
| 2007/0278249 | A1 | 12/2007 | Norem | |
| 2007/0298954 | A1 | 12/2007 | Plourde | |
| 2008/0006605 | A1 | 1/2008 | Uenoyama et al. | |
| 2008/0047702 | A1 | 2/2008 | Neff | |
| 2008/0073240 | A1 | 3/2008 | Bowers et al. | |
| 2008/0081364 | A1 | 4/2008 | Greenfield et al. | |
| 2008/0103596 | A1 | 5/2008 | Shikinami et al. | |
| 2008/0122106 | A1 | 5/2008 | Nitta et al. | |
| 2008/0156375 | A1 | 7/2008 | Wild et al. | |
| 2008/0179357 | A1 | 7/2008 | Priolo et al. | |
| 2008/0190927 | A1 | 8/2008 | Bougoulas | |
| 2008/0202075 | A1 | 8/2008 | Kronawittleithner et al. | |
| 2008/0215440 | A1 | 9/2008 | Peterson et al. | |
| 2008/0230010 | A1 | 9/2008 | Buck | |
| 2008/0230432 | A1 | 9/2008 | Bobbett et al. | |
| 2009/0145800 | A1 | 6/2009 | Bowers et al. | |

FOREIGN PATENT DOCUMENTS

| | | | | |
|---|---|---|---|---|
| DE | 19743485 | A1 | 4/1999 | |
| FR | 2757835 | | 7/1998 | |
| JP | 02-125721 | A | 5/1990 | |
| JP | 05-161692 | | 6/1993 | |
| JP | 05161692 | A | 6/1993 | |
| JP | 07-149367 | | 6/1995 | |
| JP | 07149367 | A | 6/1995 | |
| JP | 08-301322 | | 11/1996 | |
| JP | 10-323955 | | 12/1998 | |
| JP | 2007-246152 | A | 9/2007 | |
| WO | WO 2005/035386 | | 4/2005 | |
| WO | WO 2005035386 | A1 * | 4/2005 | B65D 75/36 |
| WO | WO 2005/056419 | | 6/2005 | |
| WO | WO 2005056419 | A1 * | 6/2005 | B65D 75/34 |
| WO | 2006/048687 | A1 | 5/2006 | |
| WO | 2007/078559 | A1 | 7/2007 | |
| WO | 2007/079071 | A1 | 7/2007 | |

(56) References Cited

FOREIGN PATENT DOCUMENTS

| | | | |
|---|---|---|---|
| WO | 2008/039248 A1 | 3/2008 | |
| WO | 2008/089309 | 7/2008 | |
| WO | 2008/115693 | 9/2008 | |
| WO | 2008/116177 | 9/2008 | |

* cited by examiner

RUPTURABLE BLISTER PACKAGE

CROSS-REFERENCE TO RELATED APPLICATIONS

This application claims priority to U.S. Provisional Application No. 60/847,263, filed Sep. 26, 2006, which is incorporated herein by reference.

FIELD OF THE INVENTION

The present invention relates generally to a package for supporting a plurality of consumable products. More particularly, the present invention relates to a blister package having a plurality of consumable products housed in a blister tray and covered with a rupturable blister sheet.

BACKGROUND OF THE INVENTION

It has long been known to use blister packages to house and support a plurality of consumable products such as candy, gum, mints, as well as pharmaceutical products such as capsules, tablets and the like. Blister package assemblies of this type include a blister tray having a plurality of upwardly opening compartments which support therein the consumable products. A blister sheet encloses the open upper end of the compartments to sealably cover the products contained therein.

In certain blister tray assemblies, the blister sheet may be peeled back to expose the compartments allowing for dispensing of one of the products contained therein.

In other types of blister packaging, a blister sheet is formed of rupturable material such as foil. The product may be dispensed by pushing the product from the compartment through the foil sheet rupturing the sheet thereat and allowing the product to be dispensed therefrom.

While rupturable blister sheets of this type have served adequately for their intended purpose, it has been found that certain disadvantages are inherent with foil backed blister trays. For example, rupturing the foil sheet can be noisy. This is especially a problem where it is desirable to dispense the product in a discrete manner. The foil blister sheets are also difficult and costly to manufacture and apply to the blister tray.

Heretofore, the use of plastic films as a blister sheet have not proven to be a suitable alternative. Plastic sheets by their nature stretch when force is applied thereto. Therefore, it becomes difficult, if not impossible, to puncture the sheet to dispense the product therethrough.

It is, therefore, desirable to provide a blister tray assembly which overcomes these disadvantages.

SUMMARY OF THE INVENTION

The present invention provides a blister package assembly for consumable products. The blister package assembly includes a blister tray having a plurality of open ended blister compartments opening to a common planar surface. The blister compartments support a consumable product therein. The resilient blister sheet overlies the planar surface of the blister tray and closes the open ends of the compartments. The blister sheet includes rupturable locations thereon in overlying registry with the open ends of the blister compartments. This permits the consumable product to be pushed through the blister sheets thereby dispensing the product.

In a preferred embodiment, the rupturable locations may be formed by perforations placed partially through the blister sheet. The rupturable locations may also be formed by laser cuts.

DETAILED DESCRIPTION OF THE PREFERRED EMBODIMENT

Figure 1:
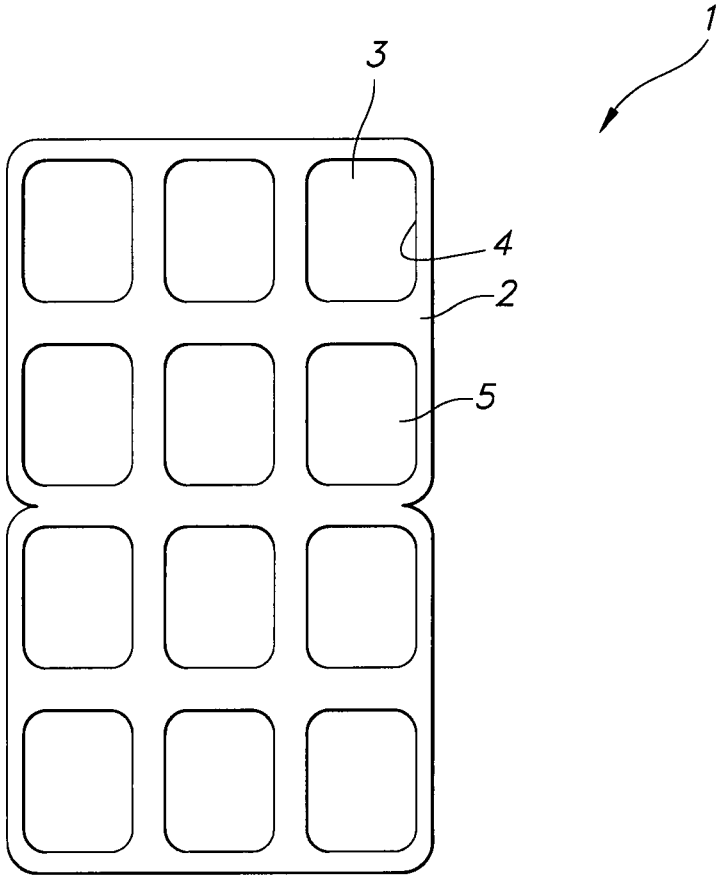
FIG. 1 is a top plan view of a conventional blister tray for use in accordance with the present invention.

The present invention provides a blister package assembly for supporting a plurality of consumable products in sealed accommodation. Referring to FIG. 1, a conventional blister tray 1 is shown. Blister tray 1 is a generally planar member formed of resilient plastic material such as PVC having an upper surface 2 and a plurality of depending blister compartments 3. Each blister compartment has an open end 4 and a cavity 5 extending therefrom for accommodating a wide variety of consumable products. In the present illustrative embodiment, the blister tray is preferably used in combination with confectionery products such as gum pieces 6.

The blister compartments may be arranged in any desirable array along the blister tray. The blister compartments are depressible and deformable so that pressure placed on the blister compartment will dispense the gum piece 6 through the open upper end 4.

In conventional fashion, a blister sheet 8 is placed over planar surface 2 to mutually enclose the open upper ends of the blister compartments. The prior art techniques for sealing blister trays includes the use of metal foil, such as aluminum foil, to seal the open upper end of the blisters. Foil sheet 8 provides the desired environmental protection to the gum pieces 6 supported within the blister compartments 3. In addition to providing the desired environmental seal, the aluminum foil sheet 8 is readily puncturable to dispense the gum piece 6 from the blister compartment 3.

While foil sheets serve adequately for their intended purpose, it has been found that certain disadvantages are inherent with the use of foil. For example, foil sheets are expensive to manufacture and apply to the blister tray. Also, rupturing the foil sheet can be noisy.

Figure 3:
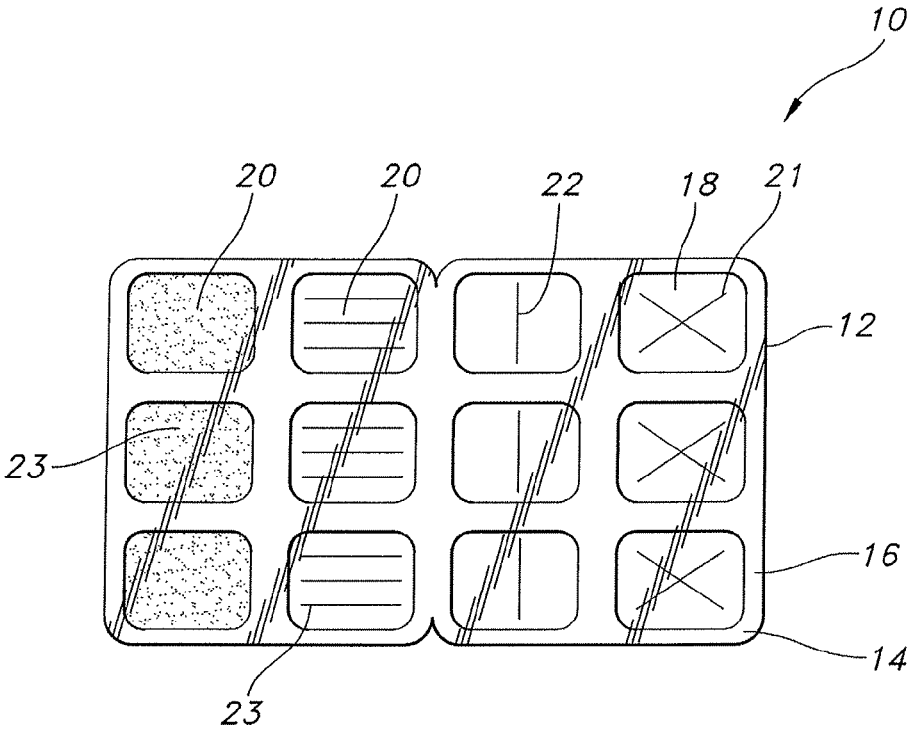
FIG. 3 is a top plan view of the blister package assembly of the present invention showing variations of perforations through the blister sheet overlying the blister tray.
Figure 4:
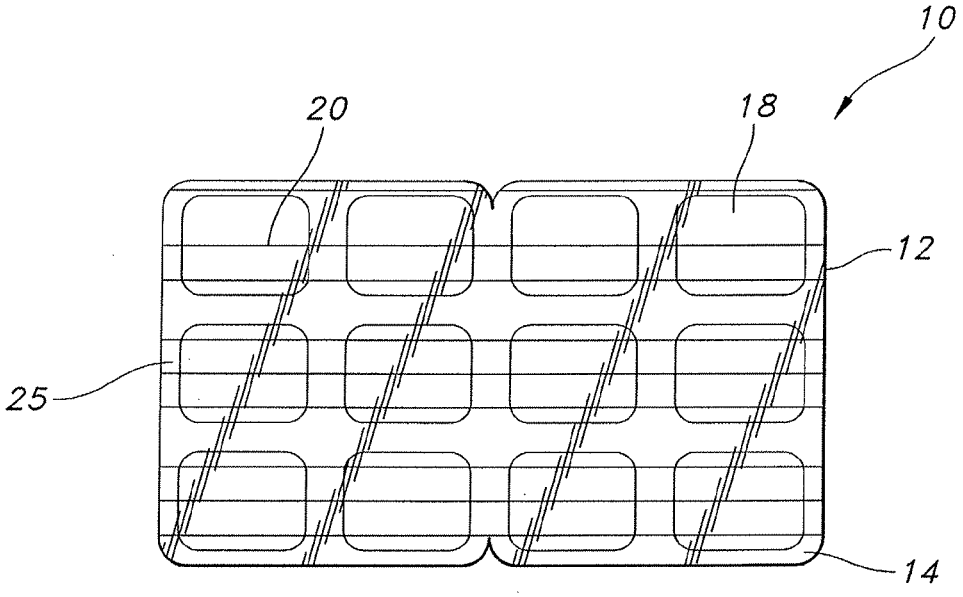
FIG. 4 is a further embodiment of the blister tray assembly of the present invention.

Referring now to FIGS. 3 and 4, the present invention provides an improved blister package assembly wherein the foil sheet is replaced by a plastic film. The plastic film is more economical to manufacture and apply to the blister tray and eliminates the noise problem associated with rupturing the aluminum sheets. However, as plastic film is resilient and stretches, it is difficult to puncture and thereby dispense a gum piece therefrom.

It is contemplated that the plastic blister film may be formed from a wide variety of materials, such as polyester or polyethylene. The blister film may be a single layer or a composite layer of various materials.

Figure 2:
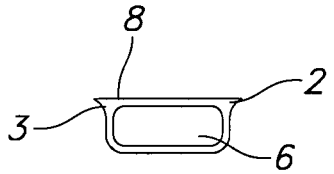
FIG. 2 shows, in cross section, one blister of a blister tray including a consumable product supported therein and a closure sheet placed thereover.

FIG. 3 shows a blister package assembly 10 the present invention. Blister package assembly 10 includes a blister tray 12 and a resilient plastic blister sheet 14. Blister tray 12 may be conventional construction formed of plastic materials such as PVC. Blister tray 12 includes a planar upper blister surface 16 and a plurality of open ended depending blister compartments 18 arranged in a array therealong. A blister sheet 14 overlies the planar surface 16 of blister tray 12 to enclose and environmentally seal the contents (not shown) in the blister compartments 18. While one particular arrangement of the blister compartments is shown, it may be appreciated that other arrangements are possible. The contents (for example, gum pieces or pellets, see FIG. 2) may be arranged with one piece in each compartment 18. Also, multiple pieces may be placed in each compartment. Further, the pieces may be arranged in various orientations within the compartment.

As above noted the plastic blister sheet 14 is stretchable and thereby resists puncturing to dispense the product therethrough. Therefore, the present invention provides rupturable locations in registry with the open ends of the blister compartments 18. These rupturable locations 20 may be placed partially through the plastic blister sheet so as to weaken the sheet, thereby resulting in puncturing of the sheet thereat upon attempts to push the product therethrough.

With specific reference to the embodiment shown in FIGS. 3 and 4, the rupturable location 20 may be formed by a wide variety of techniques. Each of these techniques are designed to weaken the plastic film over the open ended compartments so that it punches rather than stretches when the product is pushed therethrough. For example, the rupturable locations 20 may be formed by placing perforations partially through the plastic blister sheet 14. In the alternative, the rupturable locations 14 may be formed by a laser cut placed partially through the blister sheet. Similarly, any type of scoring by mechanical means may be employed to form the rupturable locations partially through the plastic blister sheet. The rupturable locations formed by such techniques are placed only partially through the sheet so as to maintain the environmental and sealing capabilities of the blister sheet 14 placed over the blister tray 12. These rupturable locations are sufficiently deep so as to allow rupturable puncturing of the sheet upon pushing the product therethrough. While it is preferred that the rupturable locations extend only partially through the sheet, in certain instances where environmental sealing may not be necessary, the rupturable locations may extend fully therethrough.

As shown in FIG. 3, one technique for providing the rupturable locations 20 is to place score lines or perforations directly in overlying registry with the open ended blister compartments 18. If perforations are provided, it is preferred that the perforations extend only partially through the blister sheet. As shown in FIG. 3, the rupturable locations may take various form. For example, a pattern such as a X pattern 21 may be provided. Of course, other shaped patterns may also be employed. A score line or perforation line 22 may also be used. Similarly, a plurality of parallel or nonparallel lines 23 may be placed in the blister sheet. Other forms of the rupturable location may include rupturable dots or other shapes 23 randomly placed in overlying registry with the open end of the blister compartments 18.

Figure 5:
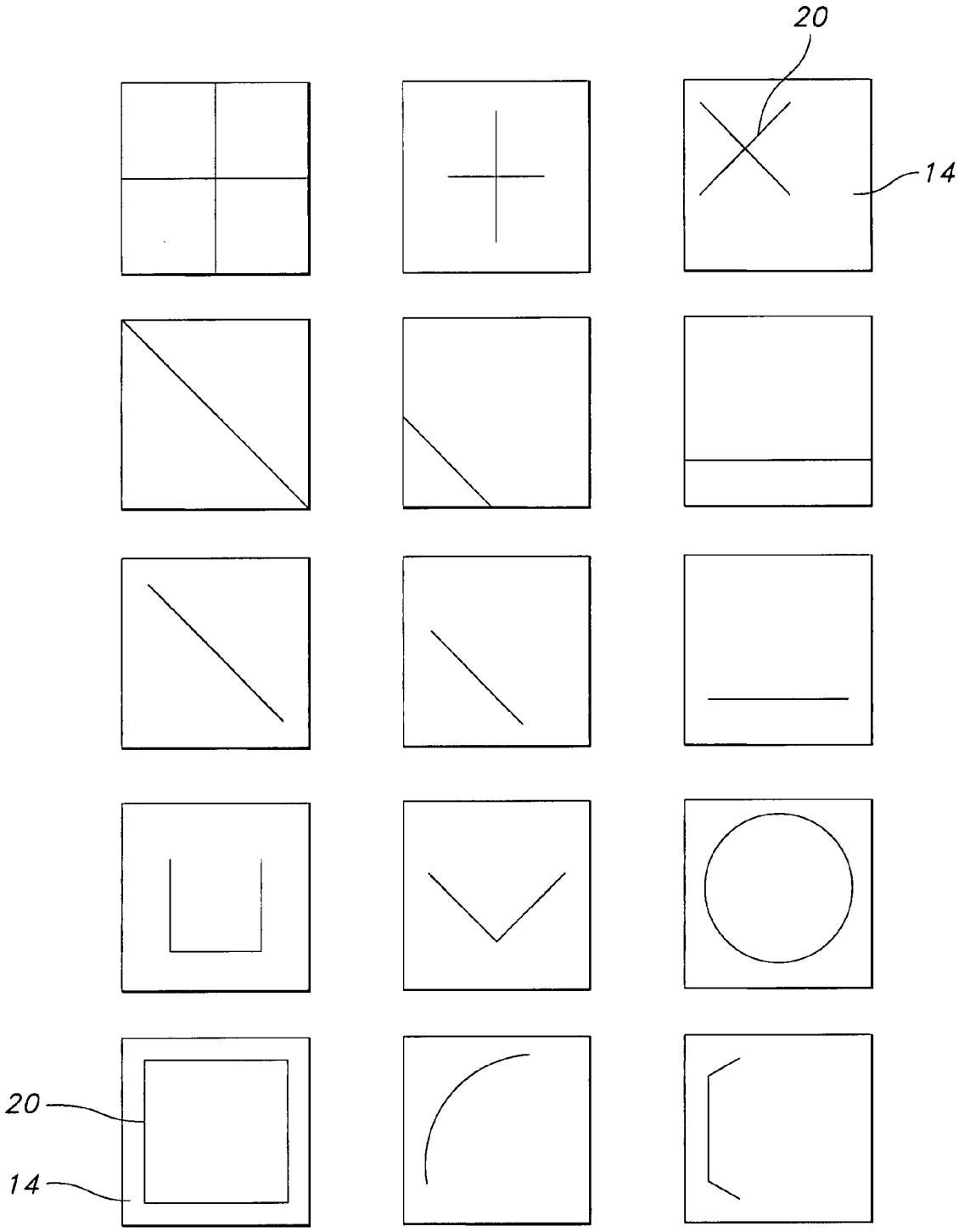
FIGS. 5-10 are schematic representations of various patterns which can be employed to provide rupturable locations in accordance with the present invention.

As shown in FIG. 5, a variety of patterns for the rupturable locations may be employed. Also, these rupturable locations may be placed at various locations in overlying registry with the open ended compartments 18. These different locations may be oriented to make the product to be dispensed at a particular location, such as the center of the compartment, to reduce the chance of dropping during dispensing. Also, different patterns and locations of the rupturable locations may be placed in the same blister package.

It is within the contemplation of present invention to provide a rupturable location over the open ends of the blister compartments 18 which weakens the plastic film thereat. Therefore, the present invention is not limited to any particular shape or configuration of the rupturable locations. Moreover, the precise location may also vary.

Turning now to FIG. 4, it can be seen that the entire sheet 14 can be manufactured either prior to placement on the blister tray or after placement thereon with specifically aligned or randomly positioned rupturable locations 20. These rupturable locations preferably take the form of elongate score, cut or perforation lines 25 extending either transversely or longitudinally across the sheet 14 so as to overlie the open ended portions of the blister compartments 18.

In the embodiment of FIG. 4, the lines 25 extend over portions of the sheet not overlying the open ended blister compartments 18. This technique may be more cost effective from a manufacturing standpoint.

Still further patterns for placement of the rupturable locations on the blister sheet 14 is shown in FIGS. 5-10.

Figure 6:
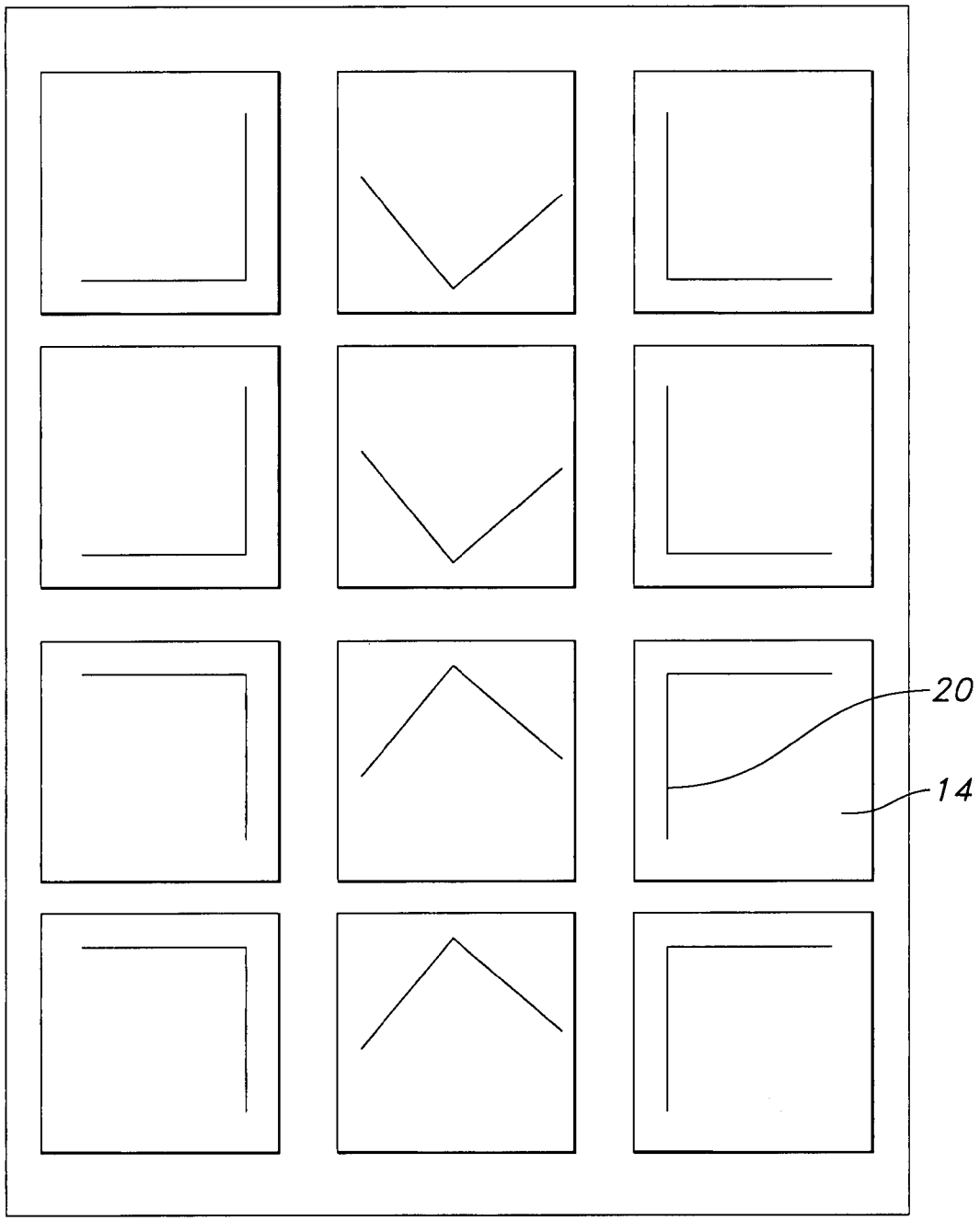
Figure 7:
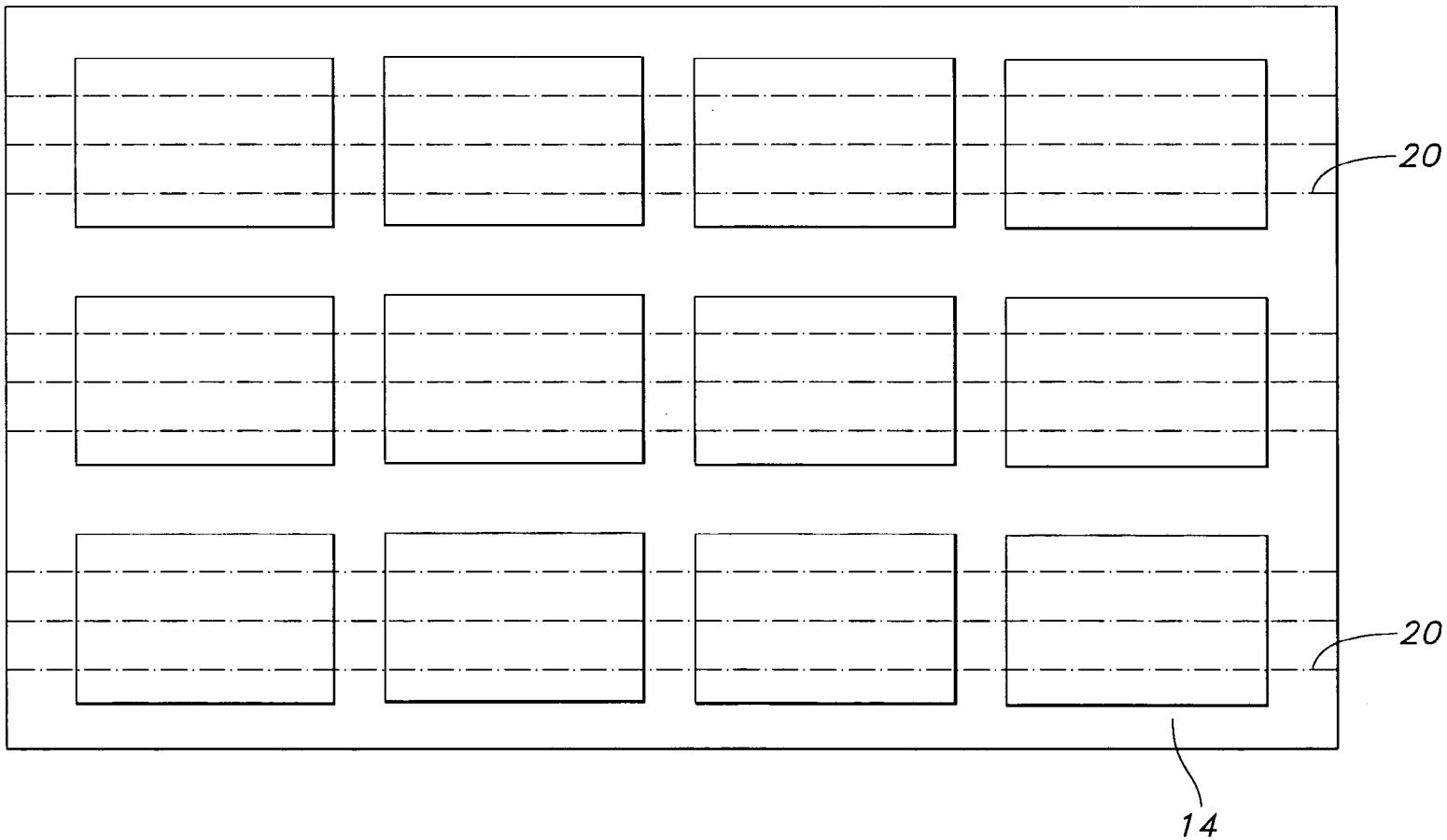
Figure 8:
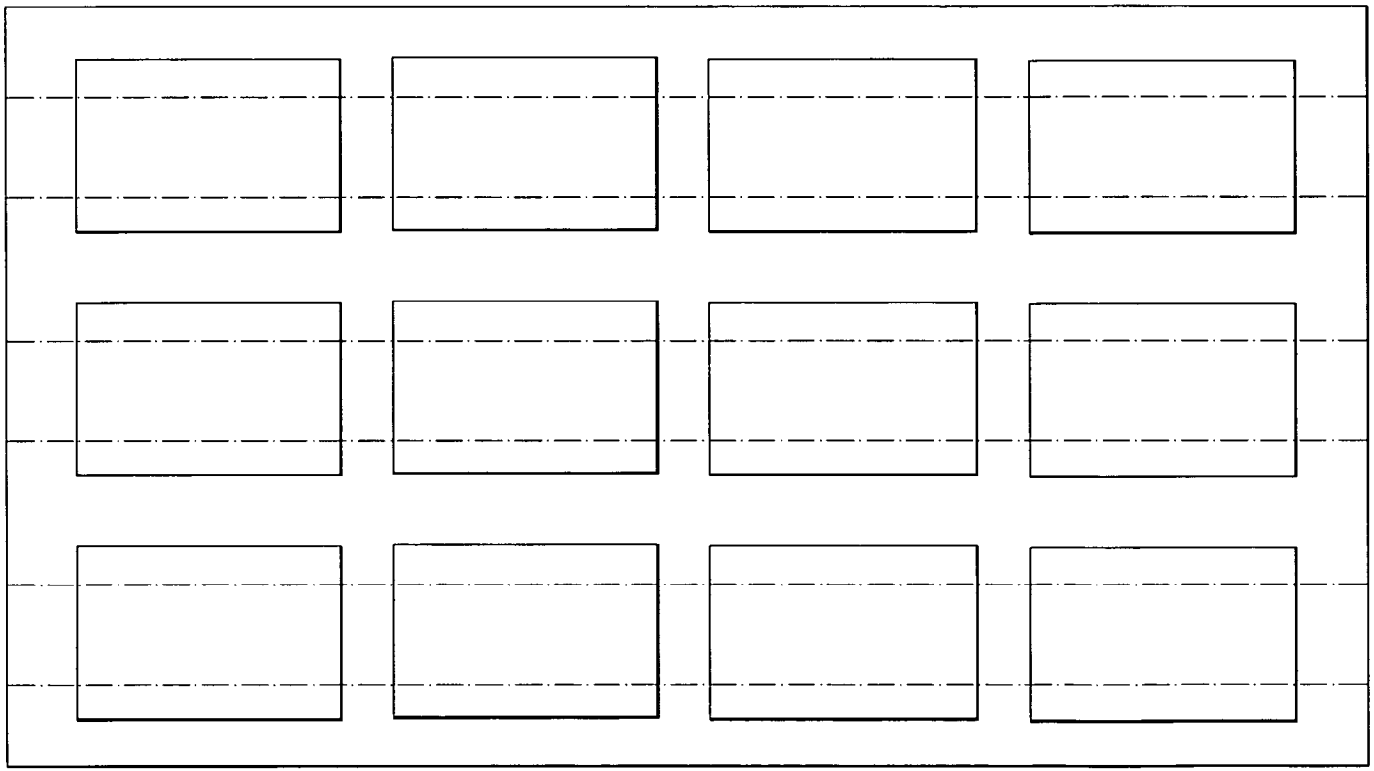
Figure 9:
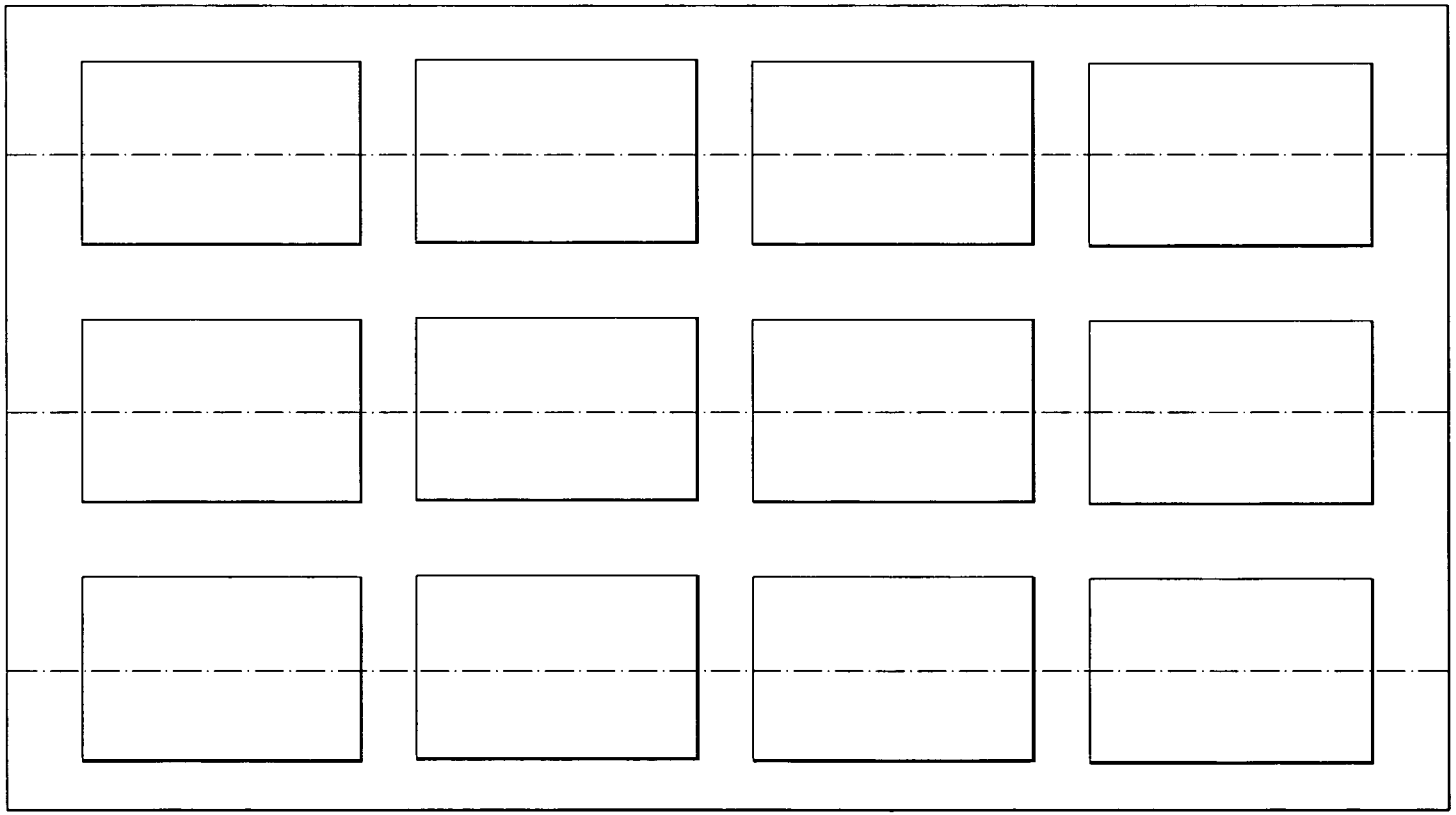

FIGS. 5 and 6 show various configurations for the rupturable locations 20. Each of these variations may be used uniformly for the entire set of blisters on one tray or may be varied within the same tray.

FIGS. 7-10 show various patterns for longitudinal lines of rupturable locations 20 on sheet 14. The lines run longitudinally along the length of the tray.

Figure 10:
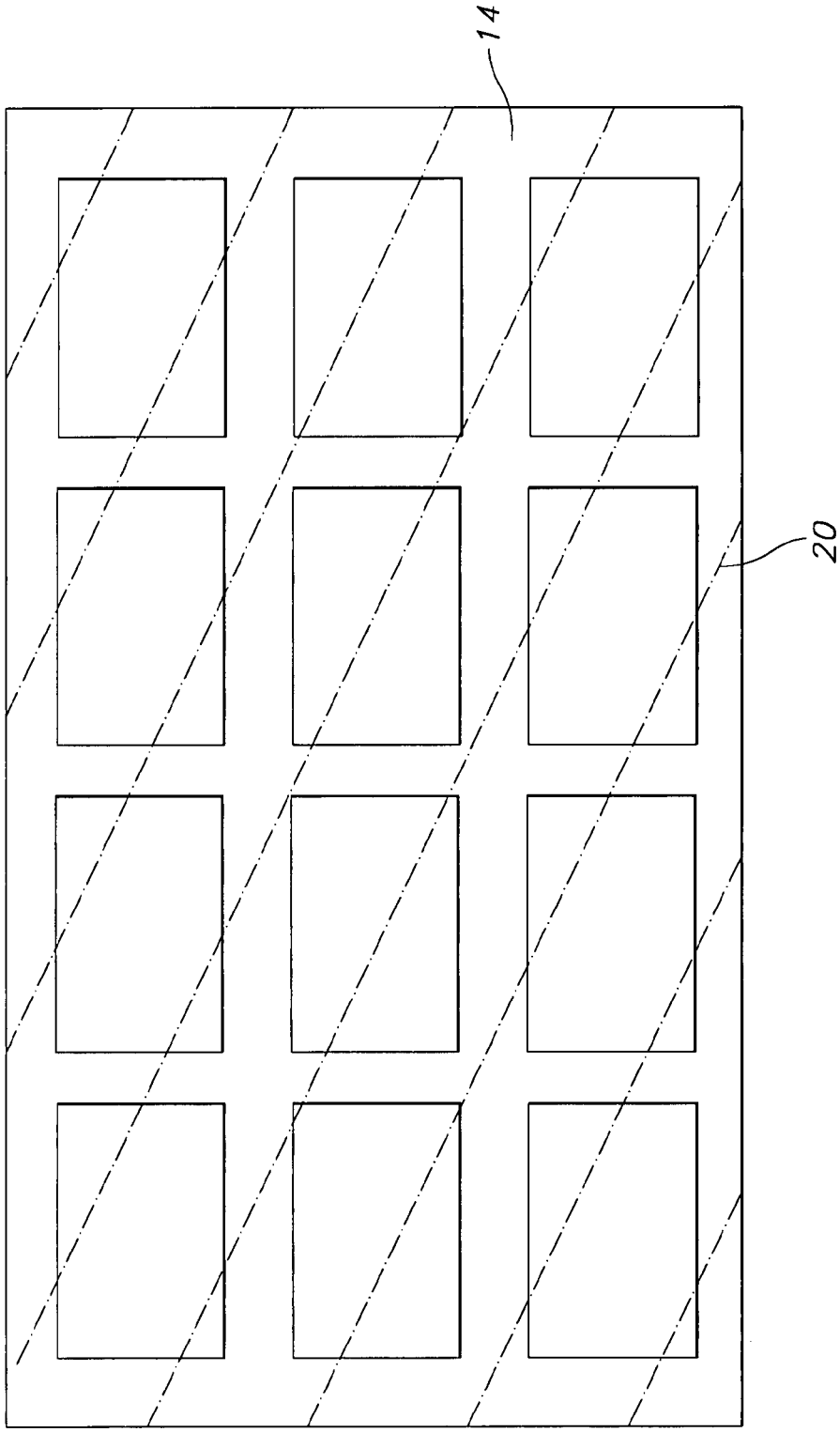

FIG. 10 shows a further variation where the lines of rupturable locations 20 extend diagonally across the sheet 14.

Various changes to the foregoing described and shown structures would now be evident to those skilled in the art. Accordingly, the particularly disclosed scope of the invention is set forth in the following claims.

What is claimed is:

1. A blister package assembly comprising:

a blister tray having a plurality of spaced open ended blister compartments opening to a common planar surface;

a plurality of consumable products, each of said blister compartments containing one of said plurality of consumable products; and a separately formed resilient single layer plastic blister film directly overlying said planar surface of said blister tray and adjacently closing said open ends of said compartment, said blister film including a pattern of rupturable locations extending across and partially through said blister film overlying said planar surface, at least portions of said rupturable locations being in overlying registry with said open ends of said blister compartments so as to permit rupturable puncturing of said blister film at said location of said overlying registry to permit dispensing of said product through said location.

2. A blister package assembly of claim 1 wherein said blister compartments are compressible and deformable.

3. A blister package assembly of claim 1 wherein said rupturable locations are formed by perforations.

4. A blister package assembly of claim 1 wherein said rupturable locations are formed by laser cuts placed partially through said blister film.

5. A package assembly of claim 1 wherein said blister film is selected from the group consisting of polyester, polyethylene and combinations thereof.

6. A package assembly of claim 1 wherein said rupturable locations are formed by mechanical cuts.

7. A package assembly of claim 1 wherein said rupturable locations are identically configured.

8. A package assembly of claim 1 wherein said rupturable locations are differently configured.

9. A package assembly of claim 1 wherein said rupturable locations are symmetrically positioned over each open surface of said compartments.

10. A package assembly of claim 1 wherein said rupturable locations are asymmetrically positioned over each open surface of said compartments.

11. A package assembly of claim 1 wherein said rupturable locations include a plurality of lines extending across said blister film.

12. A package assembly of claim 11 wherein said lines are spaced apart and parallel.

13. A package assembly of claim 11 wherein said lines are non-parallel.

14. A package assembly of claim 11 wherein said lines are non-equally spaced apart transversely across said blister film.

15. A package assembly of claim 1 wherein said rupturable locations extend entirely across said blister film.

16. A package assembly of claim 1 wherein said rupturable locations include a curved pattern in overlying registry with said open end compartments.

17. A blister package assembly comprising:

a blister tray having a plurality of spaced open ended blister compartments opening to a common planar surface said blister compartments arranged in spaced apart longitudinal columns and transverse rows;

a plurality of consumable products, each of said blister compartments containing one of said plurality of consumable products; and a separately formed single layer resilient plastic blister film overlying said planar surface of said blister tray and closing said open ends of said compartment, said blister film including a pattern of elongate rupturable locations extending partially through said blister film and in overlying registry with said open ends of said blister compartments along said columns without overlying said surface between said longitudinal columns so as to permit rupturable puncturing of said blister film at said location of said overlying registry to permit dispensing of said product through said location.

18. A package assembly of claim 17 wherein said rupturable locations include a plurality of lines extending over said columns of blister compartment.

19. A package assembly of claim 18 wherein said lines are spaced apart and parallel.

20. A package assembly of claim 18 wherein said lines are non-equally spaced apart.

* * * * *